US009497813B2

(12) United States Patent
Van Endert

(10) Patent No.: US 9,497,813 B2
(45) Date of Patent: Nov. 15, 2016

(54) LED LIGHTING ARRANGEMENT AND METHOD OF CONTROLLING A LED LIGHTING ARRANGEMENT

(71) Applicant: KONINKLIJKE PHILIPS N.V., Eindhoven (NL)

(72) Inventor: Tony Petrus Van Endert, Lommel (BE)

(73) Assignee: KONINKLIJKE PHILIPS ELECTRONICS N.V., EINDHOVEN (NL)

( * ) Notice: Subject to any disclaimer, the term of this patent is extended or adjusted under 35 U.S.C. 154(b) by 135 days.

(21) Appl. No.: 14/382,432

(22) PCT Filed: Feb. 20, 2013

(86) PCT No.: PCT/IB2013/051368

§ 371 (c)(1),
(2) Date: Sep. 2, 2014

(87) PCT Pub. No.: WO2013/128339

PCT Pub. Date: Sep. 6, 2013

(65) Prior Publication Data

US 2015/0189712 A1 Jul. 2, 2015

Related U.S. Application Data

(60) Provisional application No. 61/605,907, filed on Mar. 2, 2012.

(30) Foreign Application Priority Data

Jun. 7, 2012 (EP) ..... 12171173

(51) Int. Cl.
*H05B 37/00* (2006.01)
*H05B 33/08* (2006.01)
*H05B 37/02* (2006.01)

(52) U.S. Cl.
CPC ..... *H05B 33/0842* (2013.01); *H05B 33/089* (2013.01); *H05B 37/0245* (2013.01); *H05B 37/0263* (2013.01)

(58) Field of Classification Search
CPC ..... H05B 33/0842; H05B 33/089; H05B 37/0245; H05B 37/0263
See application file for complete search history.

(56) References Cited

U.S. PATENT DOCUMENTS

2005/0190078 A1* 9/2005 Salter ..... H05B 37/034 340/945
2006/0108956 A1* 5/2006 Clark ..... B60L 3/108 318/139

(Continued)

FOREIGN PATENT DOCUMENTS

DE 102005054969 A1 5/2007
WO 2003039204 A1 5/2003

(Continued)

*Primary Examiner* — Jason M Crawford
*Assistant Examiner* — Kurtis R Bahr

(57) ABSTRACT

A lighting arrangement (100), comprising at least one LED lighting device (105, 105', 105") comprising a LED controller which is adapted to collect and communicate a required power usage of the LED lighting device (105, 105', 105"), at least two power source units (101, 111) each connected and adapted to supply power to the LED lighting device (105, 105', 105"), and a cluster controller (106), which is adapted to collect characteristics of each power source unit (101, 111) and the characteristics of the at least one LED lighting device (105, 105', 105"), wherein the cluster controller (106) is further adapted to activate and/or deactivate at least one of the at least two power source units (101, 111) in accordance with the requested power usage of the lighting arrangement (100) and the characteristics of the power source units (101, 111) in order to activate the power source unit or power source units (101, 111) that is or are the best adapted to the requested power usage.

19 Claims, 1 Drawing Sheet

(56) References Cited

U.S. PATENT DOCUMENTS

2009/0309502 A1* 12/2009 Trattler ..... H05B 33/0818 315/160
2012/0005493 A1* 1/2012 Fujita ..... G09G 3/3648 713/300
2012/0065789 A1* 3/2012 Scelzi ..... G01K 17/20 700/291
2013/0162148 A1* 6/2013 Huang ..... H05B 33/0806 315/158
2013/0207562 A1* 8/2013 Zhang ..... H02M 7/23 315/201
2013/0294081 A1* 11/2013 O'Connor ..... F21S 2/005 362/285
2014/0368118 A1* 12/2014 Bhardwaj ..... H05B 33/0815 315/175

FOREIGN PATENT DOCUMENTS

WO 2007054811 A2 5/2007
WO 2011024062 A2 3/2011

* cited by examiner

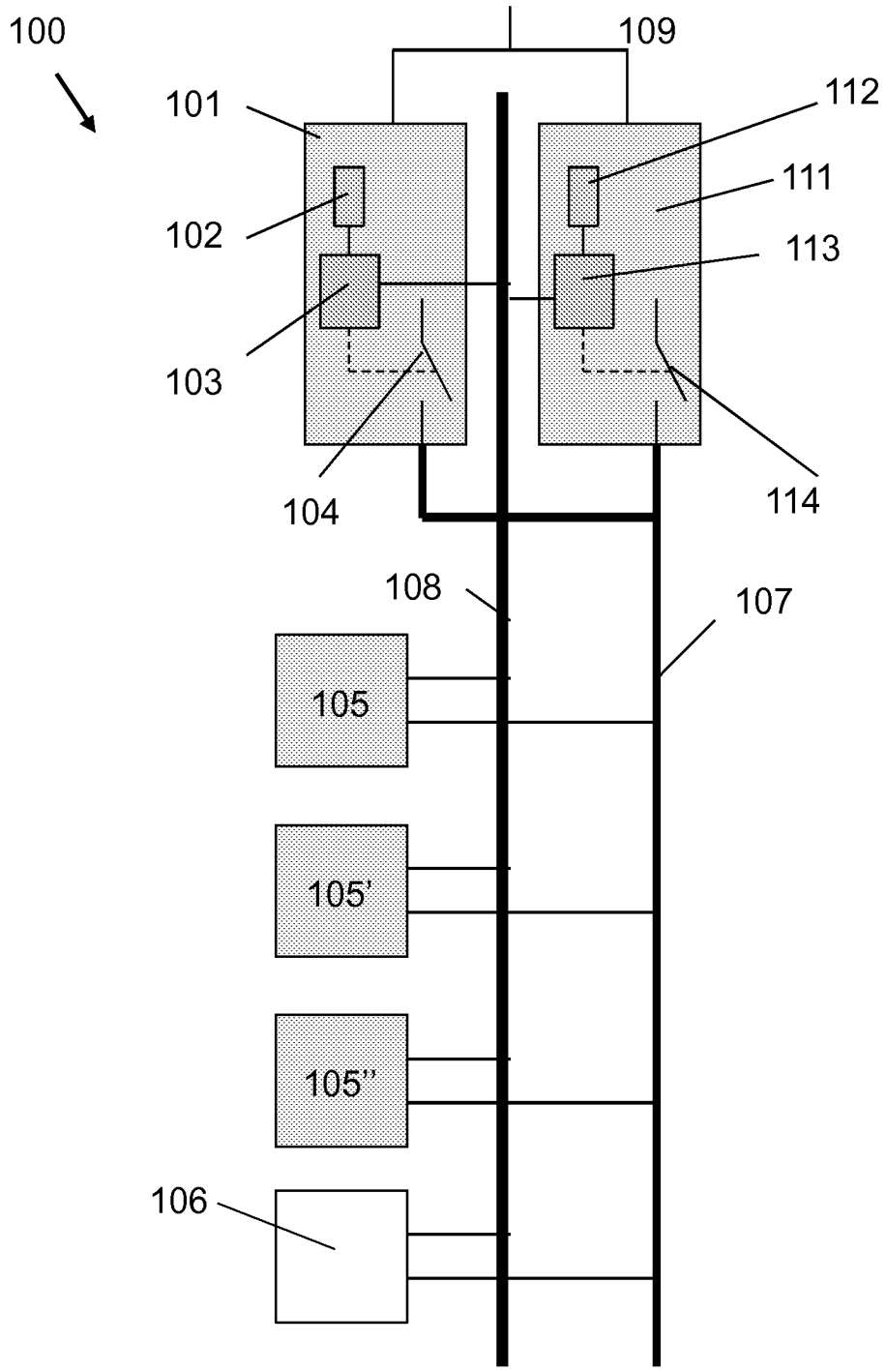
100
101
102
103
104
109
112
111
113
114
108
107
105
105'
105''
106

LED LIGHTING ARRANGEMENT AND METHOD OF CONTROLLING A LED LIGHTING ARRANGEMENT

CROSS-REFERENCE TO PRIOR APPLICATIONS

This application is the U.S. National Phase application under 35 U.S.C. §371 of International Application No. PCT/IB13/051368, filed on Feb. 20, 2013, which claims the benefit of U.S. Provisional Patent Application No. 61/605,907, filed on Mar. 2, 2012, and European Patent Application No. 12171173.3 filed on Jun. 7, 2012. These applications are hereby incorporated by reference herein.

TECHNICAL FIELD

The present invention relates to the field of lighting systems, and more specifically to a LED lighting arrangement and a method of controlling a LED lighting arrangement.

BACKGROUND OF THE INVENTION

In a lighting arrangement lighting devices may be mechanically attached via a track connector anywhere on a continuous track or rail which comprises electrical conductors for electrically connecting the lighting device to, for example, a power supply. The track comprises a housing with one open end for mechanically and electrically receiving the track connector. One track may comprise a plurality of track connectors. The track may have more than one conductor electrically isolated from the housing, so that multiple switched circuits can be used to control different lighting devices on the same track. The electrical conductors for powering the devices and for the (digital) communication are located at the inside of the housing of the track. These lighting arrangements with tracks can be mounted to ceilings or walls, lengthwise down beams, or crosswise across rafters or joists. The arrangements can also be mounted on relatively high locations, like ceilings, using rods. Typical arrangements are supplied with a line voltage (100V in Japan, 120V in North America, 240V elsewhere) via a recessed track.

Lighting arrangements with tracks on which the lighting devices are mounted are also available with a low voltage applied to the track, for example 10V, 12V, 24V or 48V supplied by a transformer. Also electrical conductors for digital control interfaces such as DALI may be incorporated in the track to independently control the lighting devices. The lighting devices are attached in different ways to the track through track connectors suitable for a specific track design.

Alternative lighting arrangements comprise luminaires that are recessed in a ceiling with electrically conducting cables interconnecting the luminaires.

Nowadays more lighting devices comprise Light Emitting Diodes (LEDs). Also track lighting arrangements are available for LED lamps. Furthermore LED modules, lamps or luminaires are available which have additional functionality. These so-called intelligent LED modules are adapted to collect and store characteristic information and parameters of the LED light sources. Furthermore these intelligent LED modules are adapted to communicate this collected information, for example on the respective power consumption or usage of a LED light source, to, for example, a cluster controller which can take the appropriate action in response to this information. Because of the flexibility of a lighting arrangement with a track system, one or more LED light sources may be connected to the tracks and the power usage varies not only as a function of time but also as a function of the number of LED modules connected to the track. Further, it may occur that the power load of a track system configuration exceeds the maximum output power of the power supply. Also in case of a lighting arrangement comprising luminaires with LEDs that are electrically interconnected with electrical wiring it may occur that the power load of the lighting arrangement exceeds the maximum power output of the power supply, because of the amount of LEDs that are connected to the power supply. Also the maximum allowed current through the interconnecting wiring can play a role in the design and maximum allowed power of such a lighting arrangement, for example in case the maximum power output of the power supply exceeds the maximum allowed current through the cables.

SUMMARY OF THE INVENTION

It is an object of the present invention to provide a LED lighting arrangement with improved efficiency.

According to an aspect of the present invention a lighting arrangement is provided, comprising at least one LED lighting device comprising a LED controller which is adapted to collect and communicate a required power usage of the LED lighting device, at least two power source units each connected and adapted to supply power to the LED lighting device, and a cluster controller, which is adapted to collect characteristics of each power source unit and the characteristics of the at least one LED lighting device, wherein the cluster controller is further adapted to activate and/or deactivate at least one of the at least two power source units in accordance with the requested power usage of the lighting arrangement and the characteristics of the power source units in order to activate the power source unit or power source units that is or are the best adapted to the requested power usage.

The invention provides for an efficient usage of the available power supply units, because the cluster controller is able to activate and/or deactivate the power source units depending on the requested power usage of the lighting arrangement, for example based on the requested power usage of the LED lighting devices and/or the maximum power load of electrical interconnection means such as electrical cables, electric tracks and electric contact pads. Each power source unit can be activated and deactivated individually.

In an embodiment each LED controller has a communication connection to the cluster controller. For example, a communication bus over which the cluster controller is able to send commands to the LED controllers and vice versa or via wireless communication.

In an embodiment each power source unit is connected via a switch to the cluster controller and wherein the cluster controller is adapted to activate and/or deactivate at least one of the at least two power source units via the switches. In this way the cluster controller directly sends commands to the switches for activating or deactivating the power source units, i.e. connecting to or disconnecting the power source units from the power supply by closing or opening of the switch.

In an embodiment the LED controller of each power source unit is connected to a switch, which is adapted to activate and/or deactivate the corresponding power source unit, and wherein the cluster controller is adapted to activate and/or deactivate at least one of the at least two power source units via the LED controller. In this embodiment the cluster controller is adapted to issue a command to each LED controller when the corresponding power source unit has to be activated or deactivated. The LED controller then performs the operation of activating or deactivating the power source unit by operating the switch of the power source unit, i.e. connecting the power source units to or disconnecting the power source units from the power supply by closing or opening of the switches.

In an embodiment the characteristics of the power source units comprise a maximum allowed power load and/or an actual power load. It is known that the energy efficiency of a power supply or power source unit drops significantly at low loads. The lighting arrangement according to the invention is able to activate the power source unit(s) such that each power source unit is operating in its most energy efficient power load range. In one example the energy efficiency of a power source unit drops from 90% to 87% in case the power load drops from 50% to 25% of the maximum allowed power load.

In an embodiment the at least two power source units comprise a first power source unit which has a lower maximum allowed power load than a maximum allowed power load of a second power source unit. In this way the cluster controller may decide to activate only the power source unit which provides a relatively low maximum power depending on the required power usage. In other words, the cluster controller is able to match the required power usage to the available power source units and their respective maximum allowed power load by activating the appropriate power source unit that, for example, is operating at an optimum efficiency.

In an embodiment a third power source unit which has a lower maximum allowed power load than the maximum power load of the first power source unit. This provides for even more flexibility of the lighting arrangement and in choosing, for example, the most energy efficient power source unit configuration that matches the required power usage of the LED lighting device(s).

In an embodiment the cluster controller is adapted to activate a warning system in case the requested power usage exceeds a specified power usage value. This is for example advantageous in case during installation too many LED lighting devices are installed in the lighting arrangement which would require a power usage that exceeds the available power load or in case the power load exceeds the maximum current that is allowed for electrical interconnection means, such as for example electrically connecting cables or tracks. By issuing a warning, an installer is able to adapt the lighting arrangement such that it matches the available power load. For example, in case of a relatively low supply voltage, e.g. lower than 60V, the power supply may be switched on during the installation of the LED lighting devices and a warning is issued when the addition of one LED lighting device would lead to exceeding the maximum available power load. In another example the power is switched off during installation and a warning may be given when the installation of the LED light sources is completed.

In an embodiment the cluster controller is adapted to switch off at least one power source unit in case a power load of this power source unit is below a specified power load value. For example, the specified power load value is linked to a minimum allowed energy efficiency.

In an embodiment the lighting arrangement further comprises a track comprising a housing with at least one open end for mechanically and electrically receiving a track connector, and comprising an electrical conductor on an inside of the housing, wherein the electrical conductor is electrically isolated from the housing, and wherein an electrical contact of the track connector is aligned with and is electrically contacting the corresponding electrical conductor, and wherein the LED lighting device is electrically connected to and mechanically attached to the track connector. Such a track allows for a flexibility in the number of LED light sources that may be incorporated in the lighting arrangement and therefore the intelligent switching of the power source units is very advantageous for such a lighting arrangement.

In an embodiment the LED lighting device is further adapted to perform a self-diagnostics test. This allows for a check of the installation of the LED lighting device in the lighting arrangement.

According to another aspect of the present invention a method of controlling a lighting arrangement is provided, the lighting arrangement comprising a LED lighting device and at least two power source units each connected and adapted to supply power to the LED lighting device, the method comprising the steps of collecting a required power usage of the LED lighting device; collecting characteristics of each power source unit; activating and/or deactivating at least one of the at least two power source units in accordance with the requested power usage of the lighting arrangement and the characteristics of the power source units in order to activate the power source unit or power source units (101, 111) that is or are the best adapted to the requested power usage.

Similar advantages apply to this method as are described with respect to the lighting arrangement according to the invention.

In an embodiment the characteristics of the power source units comprise a maximum allowed power load and/or an actual power load.

In an embodiment the method further comprises the step of activating a warning system in case the requested power usage exceeds a specified power usage value.

In an embodiment the method further comprises the step of deactivating a power source unit in case a power load of the power source unit is below a specified power load value.

In an embodiment the method further comprises the step of performing a self-diagnostics test by the LED lighting device. In a further embodiment the self-diagnostics test is activated after installation of the LED lighting device in the lighting arrangement. This prevents a wrong installation of the LED lighting device in the lighting arrangement and provides for an early warning after which an installer can adapt or repair the lighting arrangement. In a yet further embodiment the method further comprises the step of activating a warning system based on the results of the self-diagnostics test.

BRIEF DESCRIPTION OF THE DRAWINGS

These and other aspects of the present invention will now be described in more detail, with reference to the appended drawings showing example embodiments of the invention, wherein:

FIG. 1 illustrates an example embodiment of the lighting arrangement according to the present invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a lighting arrangement 100 comprising a first power source unit (PSU) 101 and a second PSU 111. The maximum allowed power load of the first PSU 101 and the second PSU 111 may be different. Each power source has a power load range in which it operates energy efficient. For example the energy efficiency of a power source unit may drop from 90% to 87% in case the power load drops from 50% to 25% of the maximum allowed power load. The PSU's 101, 111 are connected to a mains voltage 109. In other embodiments three, or even more PSU's are part of the lighting arrangement 100. Each PSU comprises a microprocessor 103, 113 and in this case a Rset resistor 102, 112 for collecting information on the characteristics of each PSU 101,111, for example characteristics such as the current power load or the maximum allowed power load. Furthermore, each PSU 101, 111, is connected via a switch 104, 114 to a power supply rail 107. The switches 104, 114 are for example high power MOSFETs. The lighting arrangement 100 further comprises LED lighting devices 105, 105', 105" which are also connected to the power supply rail 107 and additionally to a communication bus 108. The lighting arrangement 100 further comprises a cluster controller 106, for example a microprocessor, which is also connected to the power supply rail 107 and the communication bus 108. In an alternative embodiment the communication is a wireless communication.

The LED lighting devices 105, 105', 105" are so-called intelligent lighting devices which are able to collect information on specific parameters of the LED light source, for example the color point, the required power usage, etc. The required power usage of each LED lighting device 105, 105', 105" is communicated via the communication bus 108 to the cluster controller 106. Additionally, each PSU communicates via the communication bus 108 information on the characteristics of each PSU 101, 111 to the cluster controller 106. In this example, the maximum allowed power load is communicated. The cluster controller 106 operates the switches 104, 114 and activates or deactivates each PSU 101, 111 via closing or opening of the switches 104, 114 in accordance with the values of the, for example, total, required power usage of the LED lighting devices, or additionally the power usage of other electronics that is incorporated in the lighting arrangement in combination with the maximum allowed power load of the PSU's 101, 111. For example, the cluster controller 106 activates either one of or both of the PSUs 101, 111, such that the PSU's operate in the most energy efficient range. For example, only one PSU 101 is switched on. In another example, the maximum allowed power load levels of each PSU 101, 111 is different and the particular PSU is switched on which operates the most energy efficient for the required power load. For example, in case of low power usage only the PSU with lowest maximum allowed power load is switched on, in case of medium power usage only the PSU with the highest maximum allowed power usage is switched on, and in case of high power usage both PSU's are switched on. In other words, the PSU or PSU's are switched on that is or are the best or most adapted to the required power load which is determined by the required power usage of the connected LED lighting devices. The best or most adapted PSU or PSU's will operate the most energy efficient and thus the efficiency of the PSU or PSU's will be kept constant or will improve. In a practical example the maximum allowed power supply load is 300 W, and in case of 48V, the supply current should be as close as possible to 6 A (or lower) to have the PSU operate efficiently. If the required current becomes higher than 6 A, a second PSU is switched on additionally.

In another embodiment the cluster controller 106 is not connected to the power supply rail 107 and the LED microprocessors 103, 113 are able to activate and/or deactivate the switches 104, 114, and thus connecting the PSU to and/or disconnecting the PSU from the power supply, after receiving a corresponding command from the cluster controller 106 via the communication bus 108.

Optionally the cluster controller 106 activates a warning system in case the required power usage exceeds the total maximum power load of the available PSUs. Preferably, this is done during the installation of the lighting arrangement. For example, in case of a relatively low supply voltage, e.g. lower than 60V, the PSU may be switched on during the installation of the LED lighting devices and a warning is issued when the additional installation of one LED lighting device would lead to exceeding the maximum available power load. In another example the power is switched off during installation and a warning may be given when the installation of the LED light sources is completed.

The invention provides a lighting arrangement and method to increase system efficiency (saving energy) during normal operation mode and to give feedback in case of a configuration which leads to power overload.

The lighting arrangement may also comprise a track system with one or more tracks comprising a housing with at least one open end for mechanically and electrically receiving a track connector. An electrical conductor on an inside of the housing is electrically isolated from the housing and an electrical contact of the track connector is aligned with and electrically contacting the corresponding electrical conductor. One or more LED lighting devices are connected via the track connector to the track. In another embodiment of the lighting arrangement the LED lighting devices are comprised in one or more luminaires and are electrically interconnected via cables or tracks to the PSU's.

Optionally the intelligent LED lighting devices 105, 105', 105" are adapted to perform a diagnostics/self test and communicate the results to the cluster controller 106, for example via the communication bus 108. The cluster controller 106 can then inform an installer if the installation was successful or not.

It should be noted that the communication via the communication bus 108 can also be replaced by a suitable wireless communication.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, the light converting device may be connected to even further group of light sources, i.e. the above described example embodiment having a first, a second and a fourth group of light sources connected to the light converting device should not be construed as limiting the scope of the present invention. Furthermore, in the claims, the word "comprising" does not exclude other elements or steps, and the indefinite article "a" or "an" does not exclude a plurality.

The invention claimed is:

1. A lighting arrangement, comprising:

a cluster controller;

a plurality of LED lighting devices comprising a plurality of LED controllers which are adapted to collect a required power usage of each LED lighting device of the plurality of LED lighting devices and communicate the required power usage of each LED lighting device to the cluster controller; and at least two power source units each connected and adapted to supply power to the plurality of LED lighting devices, wherein the cluster controller is adapted to collect characteristics of each power source unit and the required power usage of each LED lighting device, and wherein the cluster controller is further adapted to activate at least one of the at least two power source units in accordance with a requested power usage of the lighting arrangement and the characteristics of the power source units such that the at least one of the at least two power source units operate in the most energy efficient range.

2. The lighting arrangement according to claim 1, wherein each LED controller of the plurality of LED controllers has a communication connection to the cluster controller.

3. The lighting arrangement according to claim 2, wherein a processor of each power source unit is connected to a respective switch, which is adapted to activate and/or deactivate the corresponding power source unit, and wherein the cluster controller is adapted to activate and/or deactivate at least one of the at least two power source units via the respective processor.

4. The lighting arrangement according to claim 3, wherein the characteristics of the power source units comprise a maximum allowed power load and/or an actual power load.

5. The lighting arrangement according to claim 4, wherein the at least two power source units comprise a first power source unit which has a lower maximum allowed power load than a maximum allowed power load of a second power source unit.

6. The lighting arrangement according to claim 5, further comprising a third power source unit which has a lower maximum allowed power load than the maximum power load of the first power source unit.

7. The lighting arrangement according to claim 6, wherein the cluster controller is adapted to activate a warning system in case the requested power usage exceeds a specified power usage value.

8. The lighting arrangement according to claim 7, wherein the cluster controller is adapted to switch off at least one power source unit in case a power load of this power source unit is below a specified power load value.

9. The lighting arrangement according to claim 8, wherein the lighting arrangement further comprises a track comprising a housing with at least one open end for mechanically and electrically receiving a track connector, and comprising an electrical conductor on an inside of the housing, wherein the electrical conductor is electrically isolated from the housing, and wherein an electrical contact of the track connector is aligned with and is electrically contacting the corresponding electrical conductor of the track, and wherein the plurality of LED lighting devices are electrically connected to and mechanically attached to the track connector.

10. The lighting arrangement according to claim 9, wherein at least one LED lighting device of the plurality of LED lighting devices is further adapted to perform a self-diagnostics test.

11. The lighting arrangement according to claim 1, wherein each power source unit is connected via a switch to the cluster controller and wherein the cluster controller is adapted to activate and/or deactivate at least one of the at least two power source units via the switches.

12. The lighting arrangement according to claim 1, wherein the cluster controller is configured to activate a warning system such that a warning that an installation of an additional LED lighting device would lead to exceeding a total maximum power load of the at least two power source units is issued.

13. A method of controlling a lighting arrangement, the lighting arrangement comprising a plurality of LED lighting devices, comprising a plurality of LED controllers which are adapted to collect a required power usage of each LED lighting device of the plurality of LED lighting devices and communicate the required power usage of each LED lighting device; and at least two power source units each connected and adapted to supply power to the plurality of LED lighting devices; the method comprising the steps of:

collecting the required power usage of each LED lighting device of the plurality of LED lighting devices;

collecting characteristics of each power source unit of the at least two power source units; and activating at least one of the at least two power source units in accordance with a requested power usage of the lighting arrangement and the characteristics of the at least two power source units such that at least one of the at least two power source units operate in the most energy efficient range.

14. The method according to claim 13, wherein the characteristics of the power source units comprise a maximum allowed power load and/or an actual power load.

15. The method according to claim 13, further comprising the step of deactivating at least one of the power source units in case a power load of this at least one power source unit is below a specified power load value.

16. The method according to claim 15, further comprising the step of performing a self-diagnostics test by at least one LED lighting device of the plurality of LED lighting devices.

17. The method according to claim 13, further comprising issuing a warning that an installation of an additional LED lighting device would lead to exceeding a total maximum power load of the at least two power source units.

18. A lighting arrangement, comprising:

a cluster controller;

at least one LED lighting device comprising a LED controller which is adapted to collect a required power usage of the LED lighting device and communicate the required power usage to the cluster controller; and at least one power source unit connected and adapted to supply power to the LED lighting device, wherein the cluster controller is adapted to collect characteristics of the at least one power source unit and the required power usage of the at least one LED lighting device, wherein the cluster controller is further adapted to activate at least one of the at least one power source unit in accordance with a requested power usage of the lighting arrangement and the characteristics of the at least one power source unit, and wherein the cluster controller is configured to activate a warning system such that a warning that an installation of an additional LED lighting device would lead to exceeding a total maximum power load of the at least one power source unit is issued.

19. The lighting arrangement according to claim 18, wherein the at least one power source unit is at least two power source units.

* * * * *